US007601077B2

(12) United States Patent
Serrano et al.

(10) Patent No.: US 7,601,077 B2
(45) Date of Patent: Oct. 13, 2009

(54) METHOD OF MANUFACTURING A GOLD CLUB HEAD HAVING A SUSPENDED FACE INSERT

(75) Inventors: Anthony D. Serrano, Phoenix, AZ (US); Frank D. Gunshinan, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 144 days.

(21) Appl. No.: 11/454,345

(22) Filed: Jun. 16, 2006

(65) Prior Publication Data

US 2007/0293345 A1 Dec. 20, 2007

(51) Int. Cl.
*A63B 53/04* (2006.01)

(52) U.S. Cl. ..... 473/332; 473/340; 473/342

(58) Field of Classification Search ..... 473/324–350
See application file for complete search history.

(56) References Cited

U.S. PATENT DOCUMENTS 5,575,472 A 11/1996 Magerman et al.
5,674,132 A 10/1997 Fisher
5,944,619 A * 8/1999 Cameron ..... 473/332
6,001,030 A * 12/1999 Delaney ..... 473/329
6,238,302 B1 * 5/2001 Helmstetter et al. ..... 473/340
6,273,831 B1 * 8/2001 Dewanjee ..... 473/324
6,293,878 B1 * 9/2001 Iwatsubo et al. ..... 473/521
6,328,661 B1 * 12/2001 Helmstetter et al. ..... 473/324
6,334,818 B1 1/2002 Cameron et al.
6,336,869 B1 * 1/2002 Hettinger et al. ..... 473/324
6,632,391 B1 * 10/2003 Helmstetter et al. ..... 264/319
6,893,358 B2 * 5/2005 Dewanjee et al. ..... 473/340
6,913,545 B2 * 7/2005 Jones et al. ..... 473/342
6,951,518 B2 * 10/2005 Solheim et al. ..... 473/324
6,971,960 B2 * 12/2005 Dewanjee et al. ..... 473/340
7,048,648 B2 * 5/2006 Breier et al. ..... 473/340
7,070,516 B2 * 7/2006 Dewanjee et al. ..... 473/340
7,112,147 B2 * 9/2006 Solheim et al. ..... 473/340
7,144,335 B2 * 12/2006 Breier et al. ..... 473/340
7,160,204 B2 * 1/2007 Huang ..... 473/342
7,326,128 B2 * 2/2008 Cole ..... 473/335

* cited by examiner

*Primary Examiner*—Alvin A Hunter

(57) ABSTRACT

A method of manufacturing a golf club head having a face insert that is mechanically isolated from the body of the club head involves inserting a face insert into a cavity formed in the body. The face insert is suspended above a bottom wall of the cavity by tabs that rest on the front face of the body. A curable liquid material, such as polyurethane, is injected between the face insert and the cavity. Once the polyurethane is cured, the tabs are machined off leaving a striking surface on the face insert that is flush with the front face of the body. Since the only part of the face insert that was in contact with the body is removed during the machining operation, the face insert is completely isolated from the body by the cured polyurethane.

1 Claim, 3 Drawing Sheets

FIG. 3
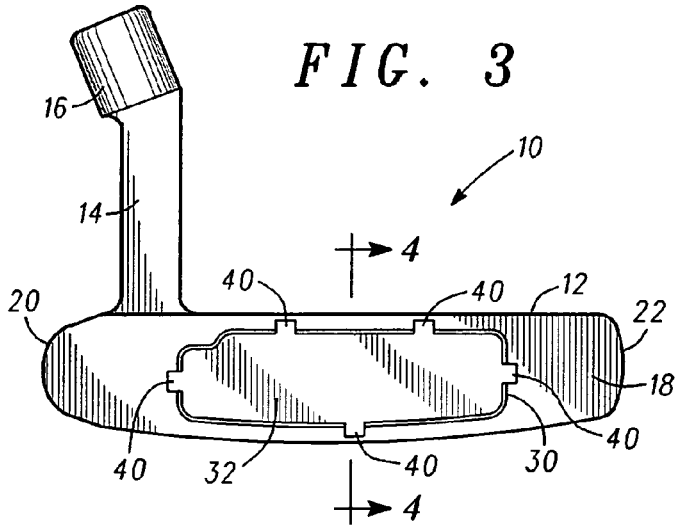
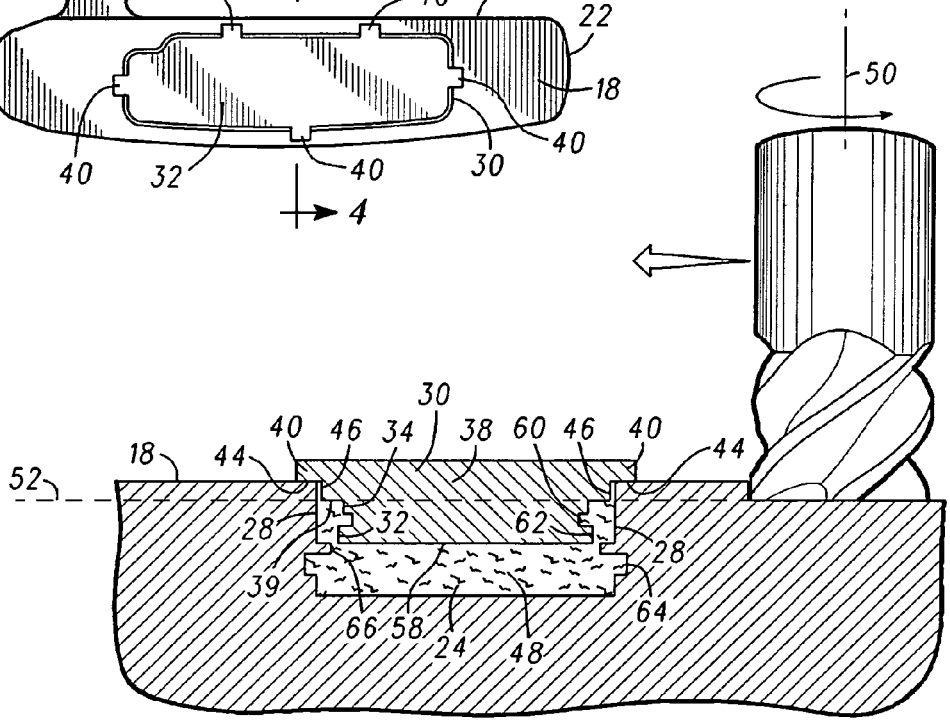
FIG. 4
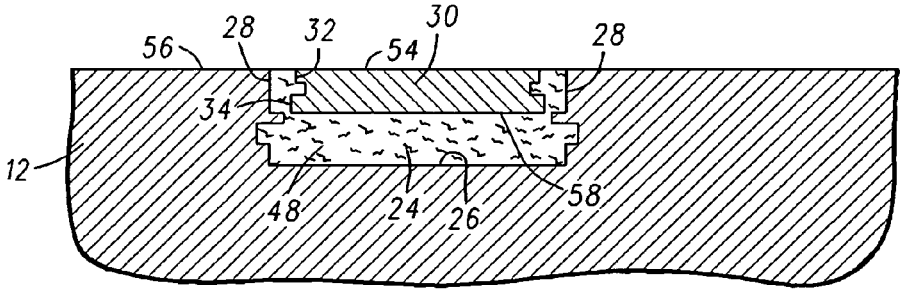
FIG. 5

METHOD OF MANUFACTURING A GOLD CLUB HEAD HAVING A SUSPENDED FACE INSERT

BACKGROUND OF THE INVENTION

This invention relates generally to golf equipment and, in particular, to golf club heads with face inserts.

U.S. Pat. No. 5,674,132 to Fisher discloses a golf putter head that includes a metal body with a front face and a non-metallic face insert disposed in the front face of the body. The face insert is a multi-layered, laminated structure bonded to the bottom surface of a tapered slot formed in the face of the club head. The use of a laminated face insert permits a composite of the material properties of the laminates to be realized in a single face insert. A drawback of the putter disclosed in the Fisher patent, however, is that since the edges of the insert laminations are exposed, they are easily damaged. Accordingly, soft laminates cannot easily be used in such an application.

U.S. Pat. No. 6,334,818 to Cameron discloses a golf club head having an insert that is retained in a cavity by either threaded fasteners or is press-fit into the cavity. A vibration damping material such as silicone is disposed in one or more cavities behind the face insert. A drawback of the golf club disclosed in Cameron, however, is that since the insert is either press fit into the cavity or retained by threaded fasteners, vibrations from the face insert are easily transmitted to the club head by direct contact or through the metallic threaded fasteners.

U.S. Pat. No. 5,575,472 to Magerman et al discloses a method of manufacturing a golf putter in which the cavity has a raised perimeter bead extending above the face of the club. The face insert is cast in place in the cavity so that it extends above the surface of the face of the club. Once the insert is cured, the perimeter bead and that portion of the face insert extending above the club face are removed to provide a planar surface. The disadvantage of the method disclosed in Magerman is that the insert is only a single material and therefore cannot be tailored for both durability of the striking face and good vibration damping characteristics.

SUMMARY OF THE INVENTION

The present invention comprises a method of manufacturing a golf club head having a face insert that is isolated from the body of the club head. According to one embodiment of the invention, the method comprises providing a body, the front face of which has a cavity for receiving the face insert. The face insert is inserted into the cavity so that its inner portion does not contact the body. The face insert has an outer portion that extends outside the cavity. The face insert is suspended in the cavity by a plurality of tabs that extend outward on the outer portion. A curable liquid material, such as polyurethane, is injected between the face insert and the cavity and allowed to cure. Once the polyurethane is cured, the outer portion of the face insert is machined off leaving a striking surface on the face insert that is flush with the front face of the body. Since the only part of the face insert that was in contact with the body is removed during the machining operation, the face insert is completely isolated from the body by the cured polyurethane. This permits relatively hard and durable materials such as metal, ceramic and carbon fiber composites to be used for the face insert while maintaining the vibration attenuating characteristics of the curable liquid material. Preferably, the polyurethane is selected to have acoustic properties that are mismatched from the acoustic properties of both the face insert and the body of the club head. This way, the sound impedance mismatch between the face insert and the polyurethane and the sound impedance mismatch between the polyurethane and the body of the club head will attenuate the impact vibrations to a greater extent than a polymer insert.

DESCRIPTION OF THE DRAWINGS

The present invention will be better understood from a reading of the following detailed description, taken in conjunction with the accompanying drawing figures in which like references designate like elements, and in which:

FIG. 3 is a front view of the golf club head shown in FIG. 1;

FIG. 4 is an enlarged cross-sectional view taken along lines 4-4 of FIG. 3;

FIG. 5 is an enlarged cross-sectional view of the golf club head shown in FIG. 4 after machining;

DESCRIPTION OF THE INVENTION

Figure 1:
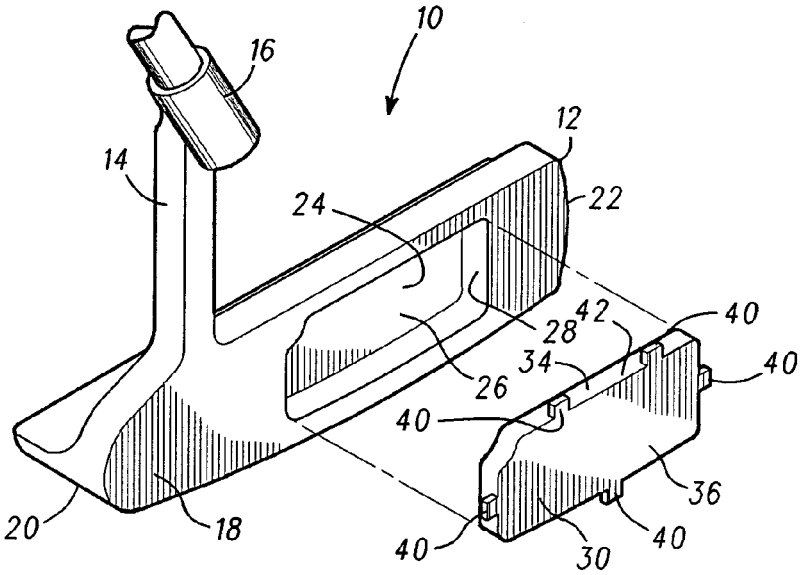
FIG. 1 is an exploded front perspective view of a golf club head incorporating features of the present invention.
Figure 2:
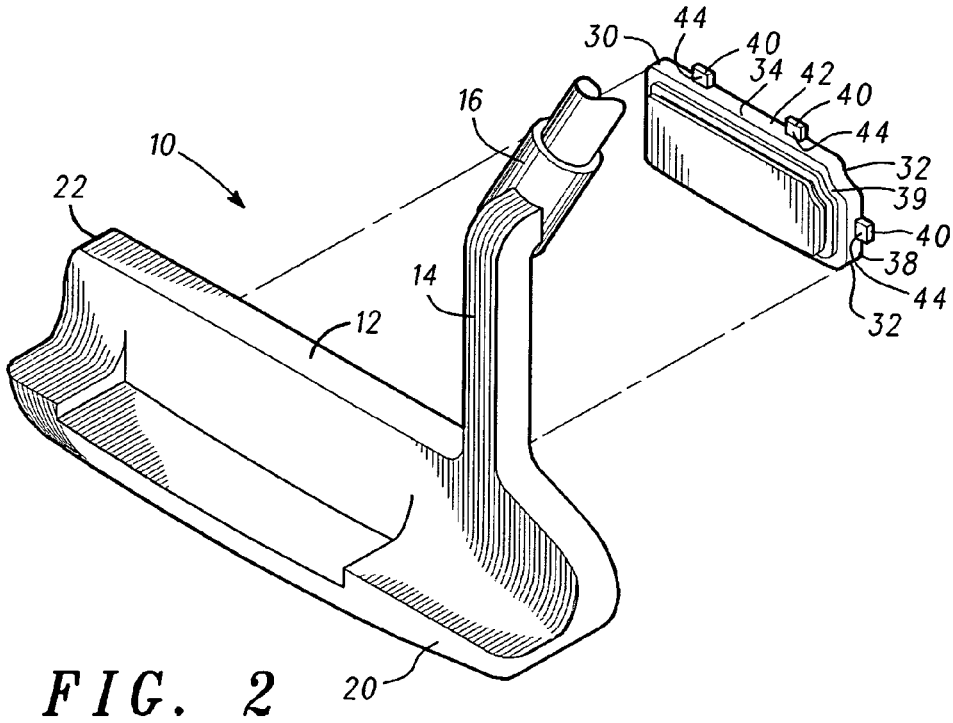
FIG. 2 is an exploded rear perspective view of the golf club head shown in FIG. 1.

With reference to FIGS. 1 and 2, a golf club head 10, preferably a golf putter head, comprises a body 12 and a hosel 14 with a boss 16 counterbored for receiving one end of a golf club shaft (not shown). The body 12 has a front face 18, a heel end 20 and a toe end 22. The front face 18 has a cavity 24 formed therein defined by a bottom wall 26 and a side wall 28. The body 12, including the cavity 24, is typically formed from a first material such as stainless steel or bronze by an investment casting process. The bottom wall 26 and side wall 28 are then shaped by a milling process to maintain precise tolerances; however, bottom wall 26 and side wall 28 may be left in the as-cast condition to increase surface roughness and thereby encourage good adhesion with an adhesive compound.

To assemble golf club head 10, a face insert 30 is placed in cavity 24. Face insert 30 is preferably made of a second material such as ceramic or carbon fiber. Face insert 30 has an inner portion 32 that is sized to fit within cavity 24 with clearance between side wall 28 and a side surface 34 of the inner portion 32. Face insert 30 has a top surface 36, an outer portion 38 that includes a plurality of tabs 40 extending outward from a side surface 42 of the outer portion 38, and an intermediate portion 39 between the inner and outer portions 32, 38.

With reference to FIGS. 3 and 4, face insert 30 is inserted into cavity 24 until the lower surfaces 44 of tabs 40 rest on front face 18 of body 12. Face insert 30 is centered within cavity 24 by a side surface 46 on intermediate portion 39 that fits closely with side wall 28 of cavity 24. Face insert 34 is clamped in place and, filler material 48 is injected between face insert 30 and cavity 24. Filler material 48 is preferably a curable liquid material such as a room temperature curing polymer, most preferably a polyurethane resin such as Lord U-2524 available from Lord Chemical Products in Erie, Pa.

As shown schematically in FIG. 4, once curable liquid material 48 has fully cured into a cured solid material, a portion of front face 18 together with outer and intermediate portions 38, 39 of face insert 30 are machined off along a plane 52 using an end mill 50 or other conventional machine tool. The machining operation also removes the tabs 40 leaving a striking surface 54 on face insert 30 and a new front face 56 on body 12 as seen in FIG. 5. Since the face insert 30 is suspended by the tabs 40 as the curable liquid material 48 is allowed to cure, the bottom surface 58 of face insert 30 is spaced from the bottom wall 26 of cavity 24. Similarly, the lateral surface 34 of inner portion 32 is spaced from side wall 28 of cavity 24. Once outer portion 38 of face insert 30 is removed, face insert 30 is fully suspended in cavity 24 and is completely isolated from body 12.

Face insert 30, being chosen from typically hard, durable materials, will have a high acoustic velocity and relatively low vibration damping characteristics. Similarly, body 12, being chosen from conventional metallic or other hard materials, will also have a high acoustic velocity and low vibration damping characteristics. Preferably, therefore, curable liquid material 48 is chosen from a group of materials having relatively low acoustic velocity and relatively high vibration damping characteristics. This causes an acoustic impedance mismatch at the interface between face insert 30 and curable liquid material 48 as well as a second acoustic impedance mismatch between curable liquid material 48 and body 12. At these interfaces, a substantial amount of the vibrational energy is reflected back into the source (i.e., back into face insert 30 at the interface between face insert 30 and curable liquid material 48 and back into curable liquid material 48 at the interface between curable liquid material 48 and body 12). These vibrational reflections cause the energy of the vibrations to be dissipated by reflection rather than being transmitted into body 12 more efficiently than simple damping by a single acoustic damping material. Accordingly, a club head manufactured in accordance with the present invention has the dual advantages of providing a durable striking surface together with superior vibration damping characteristics when compared with the pure polymer insert golf clubs of the prior art.

Optionally, as shown in FIG. 4, side surface 34 of face insert inner portion 32 may include a circumferential groove 60 or a circumferential projection 62 to provide a mechanical lock between face insert 30 and curable liquid material 48. Similarly, side wall 28 of cavity 24 may include a circumferential groove 64 or circumferential projection 66 to provide a mechanical lock between body 12 and curable liquid material 48. These grooves and projections 60, 62, 64 and 66 may be continuous or discontinuous.

Figure 6:
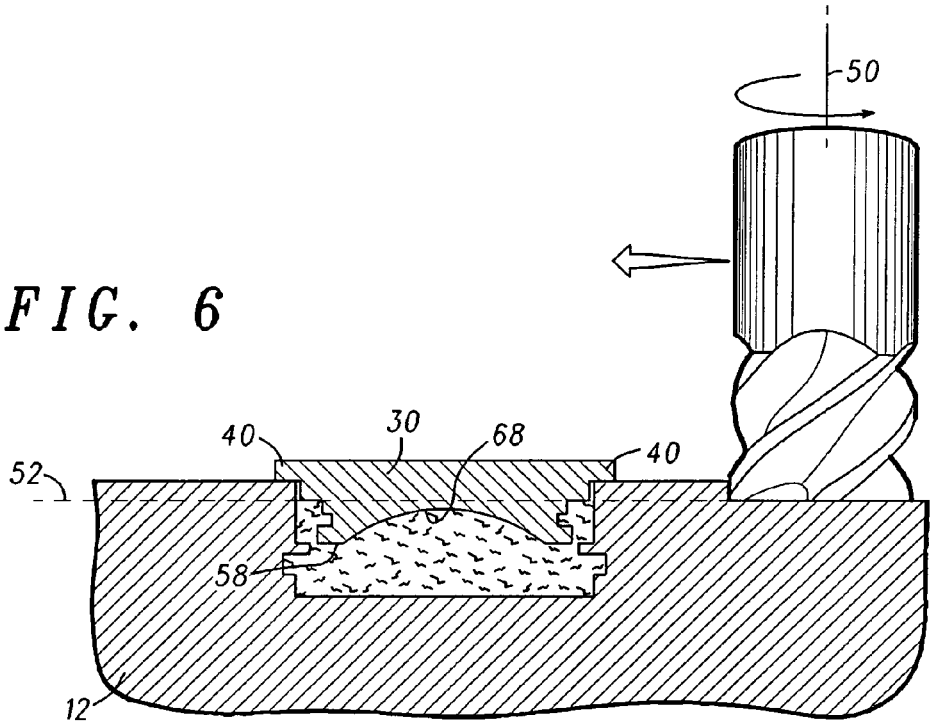
FIG. 6 is an enlarged cross-sectional view of an alternative embodiment of the golf club shown in FIG. 4.

In an alternative embodiment shown in FIG. 6, the response characteristics of the club head 10 as well as the vibration damping characteristics can be tailored by providing a depression 68 in bottom surface 58 of face insert 30.

Figure 7:
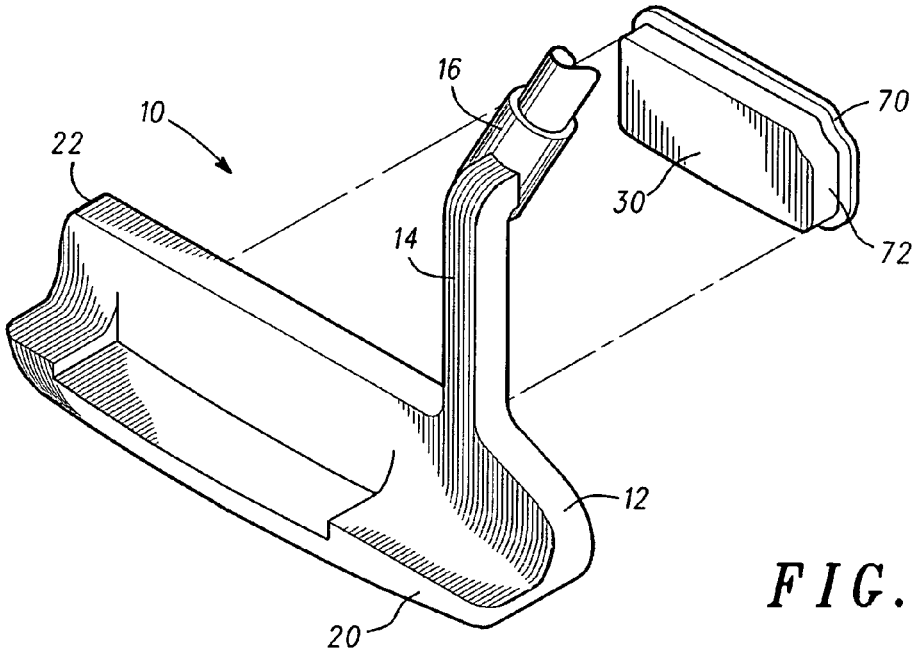
FIG. 7 is an exploded rear perspective view of an alternative embodiment of the golf club head shown in FIG. 2.

Although certain illustrative embodiments and methods have been disclosed herein, it will be apparent from the foregoing disclosure to those skilled in the art that variations and modifications of such embodiments and methods may be made without departing from the spirit and scope of the invention. For example, although the illustrative embodiment of FIGS. 1-6 includes a plurality of tabs 40 extending outward from outer portion 38 of face insert 30, face insert 30 may include a single continuous tab or flange 70 as shown in FIG. 7 extending outward from a side surface 72 thereof. Additionally, where difficult-to-machine materials such as ceramic are used for face insert 30, flange 70 may be made of a different material that is then bonded to face insert 30 (e.g., by a film-transfer adhesive). Thereafter, flange 70 may be peeled away from face insert 30 after curable liquid material 48 has fully cured. Accordingly, it is intended that the invention should be limited only to extent required by the appended claims and the rules and principals of applicable law.

What is claimed is:

1. A method of manufacturing a golf club head comprising:

providing a golf club head comprising a body made of a first material, said body having a front face with a cavity formed therein, the cavity being defined by a bottom wall and a side wall;

providing a face insert made of a second material, said face insert comprising a top surface, a bottom surface, an outer portion and an inner portion, said outer portion having a side surface and at least one tab extending outward from said side surface beyond said side wall of said cavity, said inner portion of said face insert being sized to fit within said cavity with clearance between said insert and the side wall of said cavity;

inserting said inner portion of said face insert into said cavity so that said at least one tab on said outer portion remains extended beyond said side wall of said cavity and contacts said front face of said body so that said face insert is suspended in said cavity;

injecting a curable liquid material into said cavity;

curing said curable liquid material into a cured solid material so that said face insert is held within said cavity solely by said cured solid material; and removing a portion of said front face together with said outer portion of said face insert and any part of said inner portion of said face insert that is in contact with the side wall of said cavity, thereby yielding a golf club head with a new striking surface on said face insert, a new front face on said body, and a face insert that is fully isolated from said cavity by said curable liquid material;

wherein said face insert further comprises an intermediate portion between said outer portion and said inner portion, said intermediate portion having a side surface located outward beyond a side surface of said inner portion to provide a close fit with said side wall of said cavity; and the removing of said outer portion of said face insert together with a portion of said front face further comprises removing said intermediate portion of said face insert.

* * * * *

UNITED STATES PATENT AND TRADEMARK OFFICE

CERTIFICATE OF CORRECTION

PATENT NO. : 7,601,077 B2
APPLICATION NO. : 11/454345
DATED : October 13, 2009
INVENTOR(S) : Serrano et al.

It is certified that error appears in the above-identified patent and that said Letters Patent is hereby corrected as shown below:

Title Page, Item (54) Column 1 (Title), line 1, delete "GOLD" and insert --GOLF-- after the text reading "METHOD OF MANUFACTURING A"

Column 1, line 1, delete "GOLD" and insert --GOLF-- after the text reading "METHOD OF MANUFACTURING A"

Signed and Sealed this

Twenty-sixth Day of January, 2010

David J. Kappos

David J. Kappos
*Director of the United States Patent and Trademark Office*